US008696075B1

(12) United States Patent
Rios

(10) Patent No.: US 8,696,075 B1
(45) Date of Patent: Apr. 15, 2014

(54) OUTDOOR COOKING ORGANIZATION SYSTEM

(76) Inventor: Angel L. Rios, Chicago, IL (US)

( * ) Notice: Subject to any disclaimer, the term of this patent is extended or adjusted under 35 U.S.C. 154(b) by 144 days.

(21) Appl. No.: 13/524,707

(22) Filed: Jun. 15, 2012

Related U.S. Application Data

(63) Continuation-in-part of application No. 12/553,935, filed on Sep. 3, 2009, now abandoned.

(51) Int. Cl.
*A47B 83/00* (2006.01)
*A47B 97/00* (2006.01)

(52) U.S. Cl.
USPC ..... 312/237; 312/249.12; 312/313; 312/290; 312/7.1; 126/25 R

(58) Field of Classification Search
USPC ..... 312/237, 236, 7.1, 208.1, 209, 249.1, 312/249.8, 249.11, 249.12, 249.13, 223.6, 312/313, 280, 281, 283, 290; 126/25 R, 29; 280/47.19, 47.26, 79.2
See application file for complete search history.

(56) References Cited

U.S. PATENT DOCUMENTS

| | | | | | |
|---|---|---|---|---|---|
| 591,574 | A | * | 10/1897 | Smith | 434/432 |
| 767,908 | A | | 8/1904 | Miller | |
| 804,089 | A | * | 11/1905 | Blanc et al. | 312/249.12 |
| 1,409,445 | A | * | 3/1922 | Hillyer et al. | 312/236 |
| 1,543,980 | A | | 6/1925 | Blood | |
| 1,884,325 | A | | 10/1932 | Sommer | |
| 1,951,238 | A | | 3/1934 | Fiene | |
| 1,955,203 | A | * | 4/1934 | Salomon | 312/236 |
| 1,985,412 | A | | 12/1934 | Jackson | |
| 2,272,819 | A | * | 2/1942 | Poetsch et al. | 312/198 |
| 2,309,513 | A | | 1/1943 | Ferdinand | |
| 2,826,879 | A | | 3/1958 | Evans | |
| 2,894,794 | A | * | 7/1959 | Mays | 312/313 |
| 3,082,050 | A | | 3/1963 | Baxter et al. | |
| 3,811,559 | A | | 5/1974 | Carter | |
| 3,874,531 | A | | 4/1975 | Mayo | |
| 3,889,967 | A | | 6/1975 | Sauer | |
| 3,915,529 | A | | 10/1975 | Bernier | |
| 3,984,162 | A | | 10/1976 | Zozzaro | |
| 4,092,973 | A | | 6/1978 | Bernazzani | |
| D285,852 | S | | 9/1986 | Clark | |
| 4,706,817 | A | | 11/1987 | Greathouse | |
| 4,862,792 | A | | 9/1989 | Lerma, Jr. | |
| 4,936,594 | A | | 6/1990 | Oliver, III | |
| 5,013,055 | A | | 5/1991 | Labrum | |
| 5,269,599 | A | | 12/1993 | Moring | |
| 5,518,310 | A | * | 5/1996 | Ellman et al. | 312/249.12 |
| 5,642,898 | A | | 7/1997 | Wise | |
| 5,664,853 | A | | 9/1997 | Nickolaus, Jr. | |
| 5,683,157 | A | | 11/1997 | Peterson et al. | |
| 5,806,944 | A | | 9/1998 | Greenfield | |

(Continued)

*Primary Examiner* — James O Hansen

(57) ABSTRACT

An outdoor cooking accessory organization system includes an outdoor cooker and an outdoor cooking accessory cart. The cart has a plurality of storage bays located in the cart top surface with an open top for receiving an item. The cart has a sliding drawer and a retractable cooking shelf with a cutting board surface on a cooking shelf first surface and a grill located on a cooking shelf second surface. The cooking shelf is pivotally mounted and is locked into position via a locking mechanism in a first position with the cutting board surface facing upwards or a second position with the grill facing upwards. The cart has a power supply with a connecting cord for connecting to a power source and a power outlet operatively connected to the power supply.

11 Claims, 13 Drawing Sheets

(56) References Cited

U.S. PATENT DOCUMENTS

| | | | | |
|---|---|---|---|---|
| 5,887,878 | A | 3/1999 | Tisbo et al. | |
| D425,328 | S | 5/2000 | Welling | |
| 6,086,073 | A | 7/2000 | Tisbo et al. | |
| 6,493,217 | B1 | 12/2002 | Jenkins, Jr. | |
| 6,844,494 | B1 | 1/2005 | Nevins | |
| 7,324,334 | B2 | 1/2008 | Sween et al. | |
| 7,338,139 | B2 | 3/2008 | Peter | |
| 7,694,823 | B2 | 4/2010 | Fontanesi | |
| 2002/0096509 | A1 * | 7/2002 | Von Mosshaim | 219/452.11 |
| 2002/0130598 | A1 | 9/2002 | Schmidt | |
| 2005/0073119 | A1 | 4/2005 | Kirakosyan | |
| 2006/0062415 | A1 | 3/2006 | Hesketh | |
| 2006/0076861 | A1 * | 4/2006 | Baughman | 312/314 |
| 2007/0029746 | A1 | 2/2007 | Brennan, Jr. | |
| 2008/0000171 | A1 | 1/2008 | McKay et al. | |
| 2008/0245357 | A1 * | 10/2008 | Meether et al. | 126/25 R |

* cited by examiner

OUTDOOR COOKING ORGANIZATION SYSTEM

CROSS REFERENCE

This application claims priority to U.S. non-provisional application Ser. No. 12/553,935 filed Sep. 3, 2009 as a continuation-in-part, the specification of which is incorporated herein by reference in its entirety.

BACKGROUND OF THE INVENTION

A barbeque grill is a device used for cooking food outside that typically uses heat applied below the food to be cooked. Grilling has existed in the United States since pre-colonial times and has continued to gain in popularity through the years. For someone grilling today, natural gas or propane would typically used for fuel in a gas grill while charcoal briquettes would be used in a non-gas grill. Additional items are often used during the cooking process such as tongs and other utensils, spices or paper towels. Normally, these items would be kept inside the house, and then brought out to the grill when needed. The present invention features an outdoor cooking organization system to store items close to the grill that are often needed when cooking outside.

SUMMARY

The present invention features an outdoor cooking accessory organization system for use when cooking. In some embodiments, the system comprises an outdoor cooker. In some embodiments, the system comprises an outdoor cooking accessory cart.

In some embodiments, the cart comprises a generally planar cart top surface located at an angle between 90 degrees and 135 degrees with respect to the cart front surface. In some embodiments, the cart top surface is located at an angle between 45 degrees and 90 degrees with respect to the cart rear surface. In some embodiments, the cart top surface comprises a generally planar back plate located on a cart top surface rear edge that projects out and away from the cart top surface. In some embodiments, the back plate lies on a plane with the cart rear surface. In some embodiments, the cart top surface comprises a generally planar front lip extension located on a cart top surface front edge that projects out and away from the cart top surface. In some embodiments, the front lip extension lies on a plane with the cart top surface.

In some embodiments, the cart comprises a plurality of storage bays. In some embodiments, the storage bay comprises an aperture located in the cart top surface fluidly connected to a storage cavity located within the cart. In some embodiments, the storage bay comprises an open top for receiving an item for storage.

In some embodiments, the cart comprises a drawer. In some embodiments, the drawer is inserted through an aperture located in the cart front surface. In some embodiments, the drawer slides in a horizontal plane. In some embodiments, the drawer comprises an open top for receiving an item for storage.

In some embodiments, the cart comprises a generally planar retractable cooking shelf having a cutting board surface located on a cooking shelf first surface and a grill located on a cooking shelf second surface. In some embodiments, the cooking shelf is pivotally mounted through a center cross-section. In some embodiments, the cooking shelf slides to be retracted from the cart. In some embodiments, upon being slid from the cart, the cooking shelf rotates in a plane parallel to the cart front surface. In some embodiments, the cooking shelf is locked into position in a first position with the cutting board surface facing upwards and parallel with the cart bottom surface. In some embodiments, the cooking shelf is locked into position in a second position with the grill facing upwards parallel with the cart bottom surface In some embodiments, the cart comprises a power supply having a connecting cord for connecting to a power source. In some embodiments, a power outlet is located on the cart and operatively connected to the power supply.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
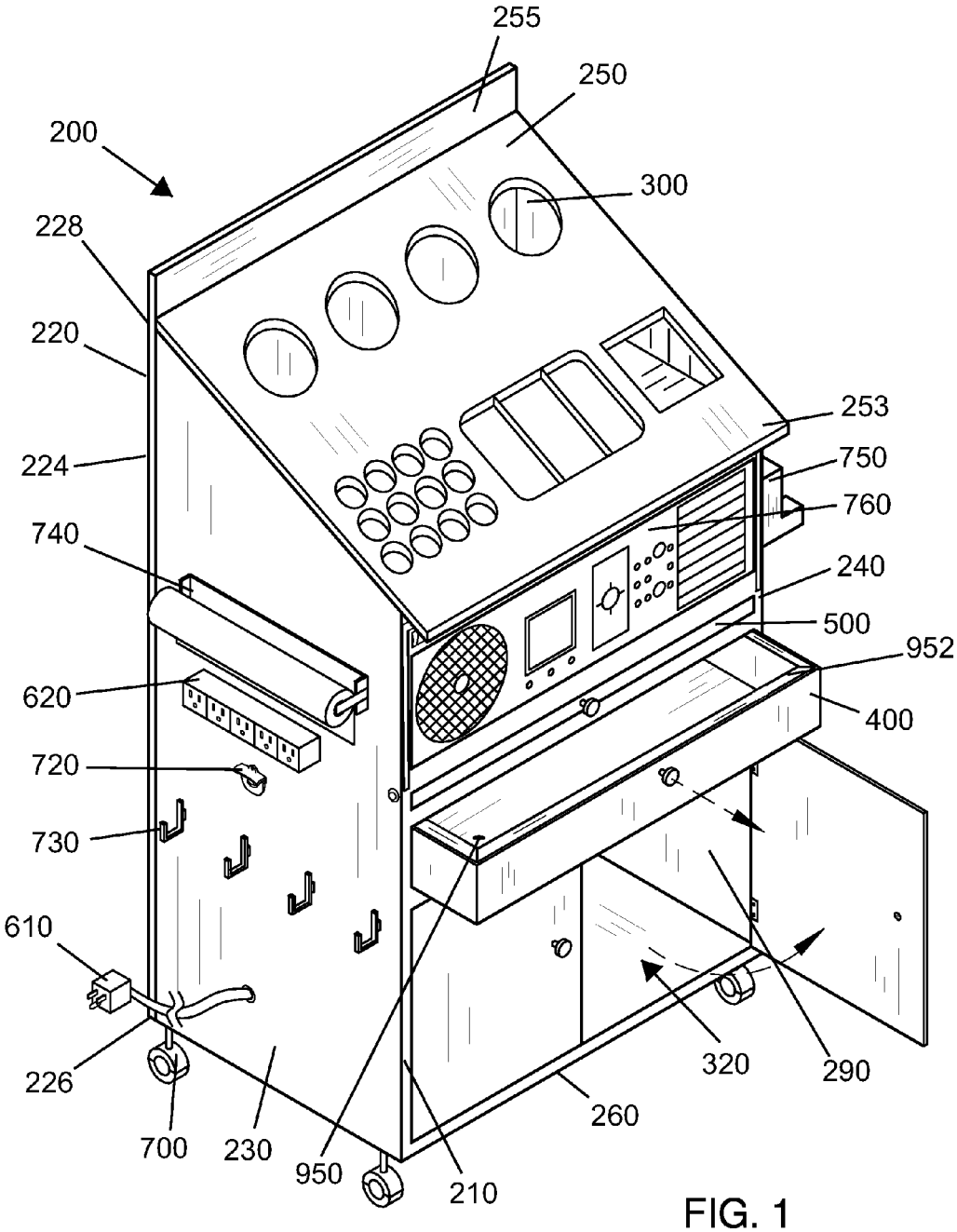
FIG. 1 is a perspective view of the present invention.

Following is a list of elements corresponding to a particular element referred to herein:

100 Outdoor cooking organization system
110 Outdoor cooker
200 Outdoor cooking accessory cart
210 Cart front surface
212 Cart front surface first side edge
214 Cart front surface second side edge
216 Cart front surface bottom edge
218 Cart front surface top edge
220 Cart rear surface
222 Cart rear surface first side edge
224 Cart rear surface second side edge
226 Cart rear surface bottom edge
228 Cart rear surface top edge
230 Cart first side surface
232 Cart first side surface first side edge

Figure 2:
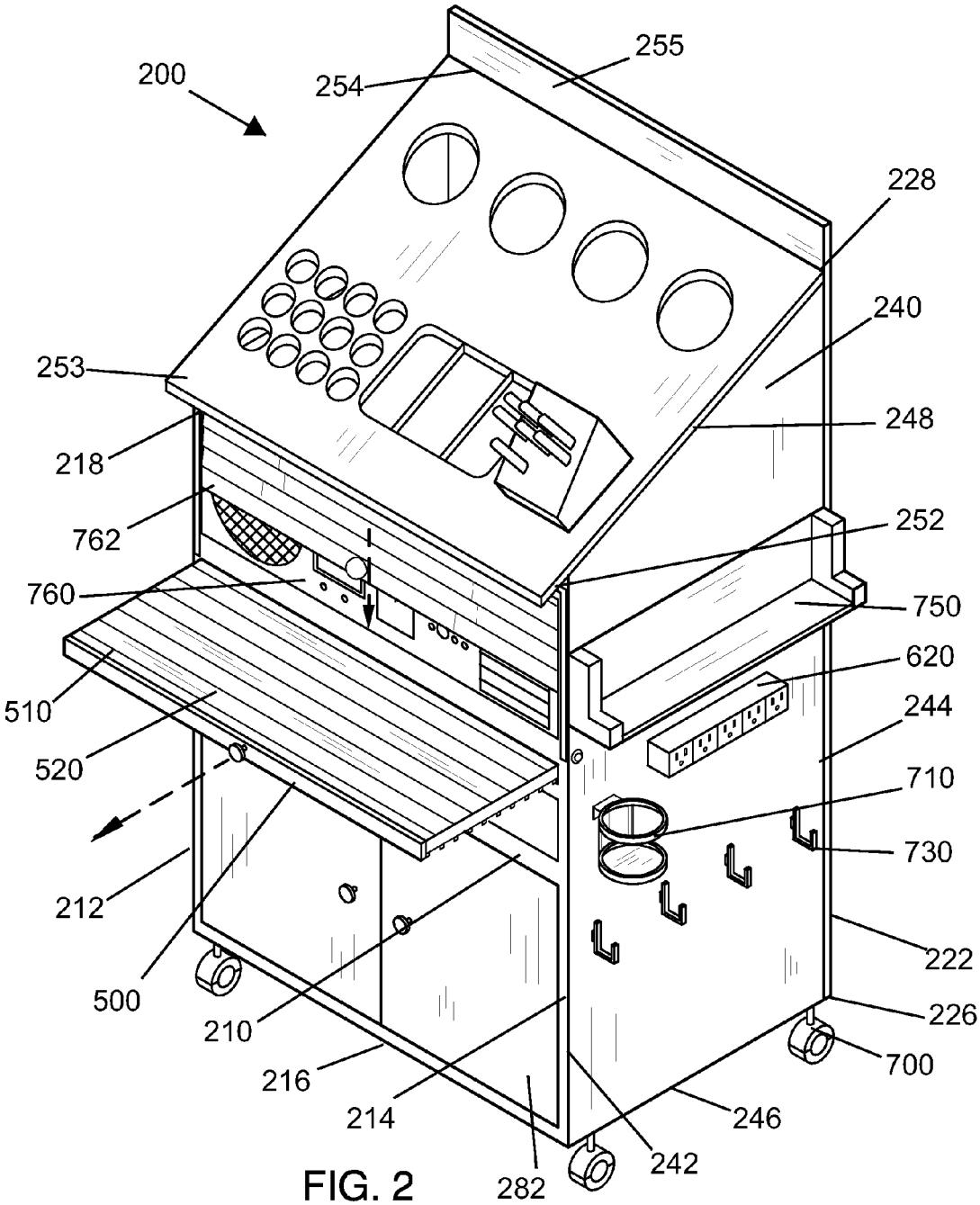
FIG. 2 is a perspective view of the outdoor cooking accessory cart of the present invention.
Figure 3:
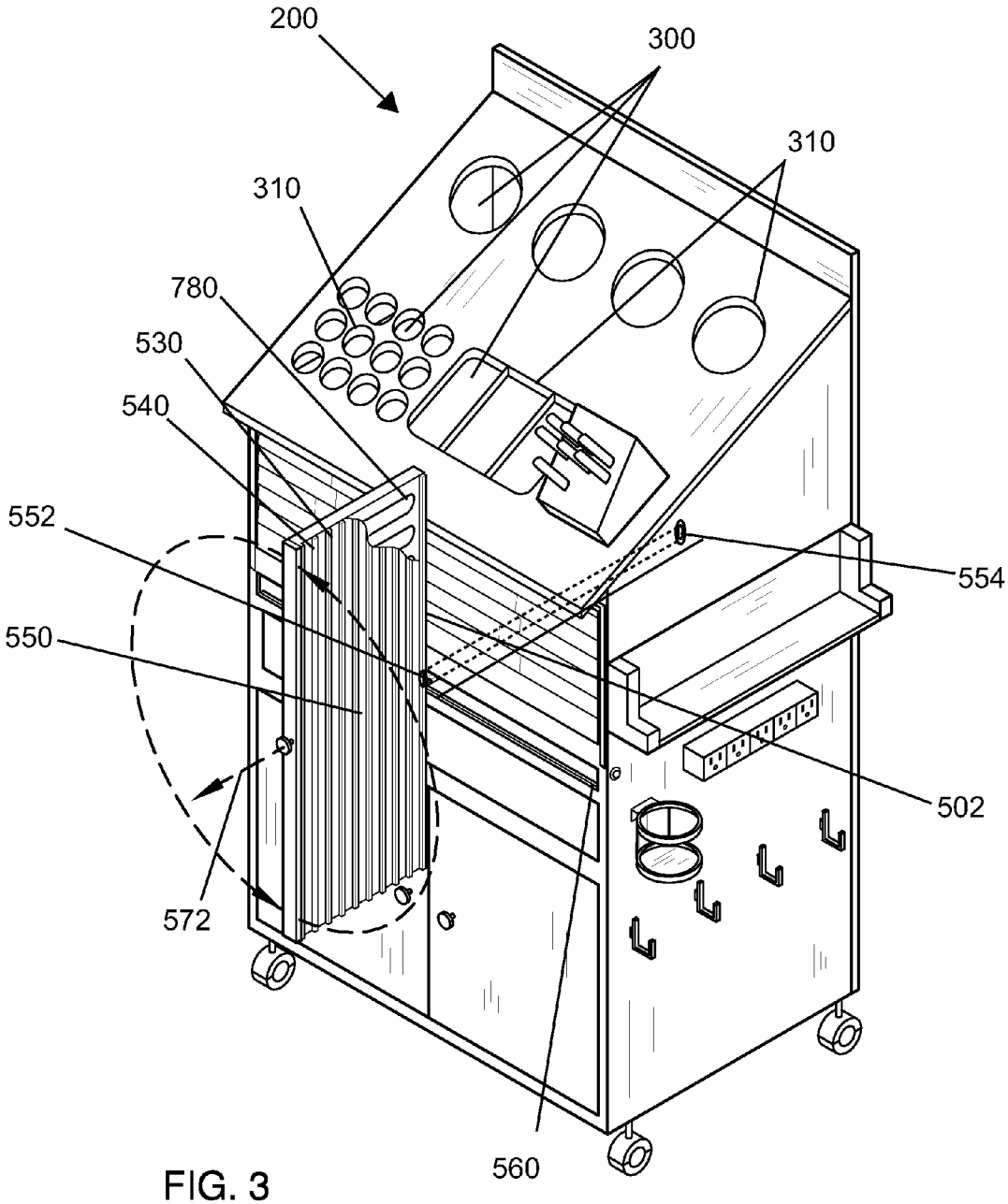
FIG. 3 is a perspective view of the outdoor cooking accessory cart of the present invention.
Figure 4:
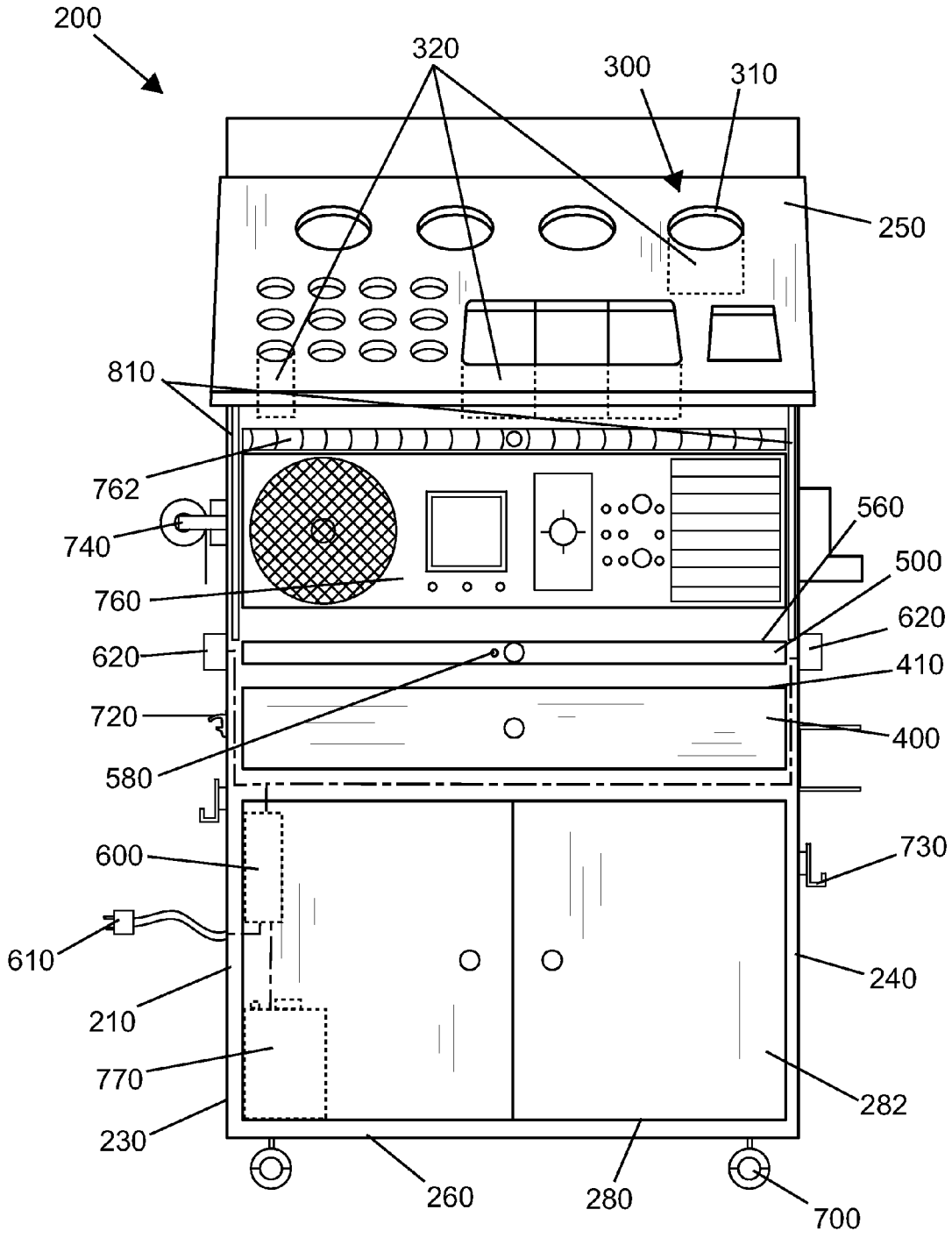
FIG. 4 is a front view of the outdoor cooking accessory cart of the present invention.
Figure 5:
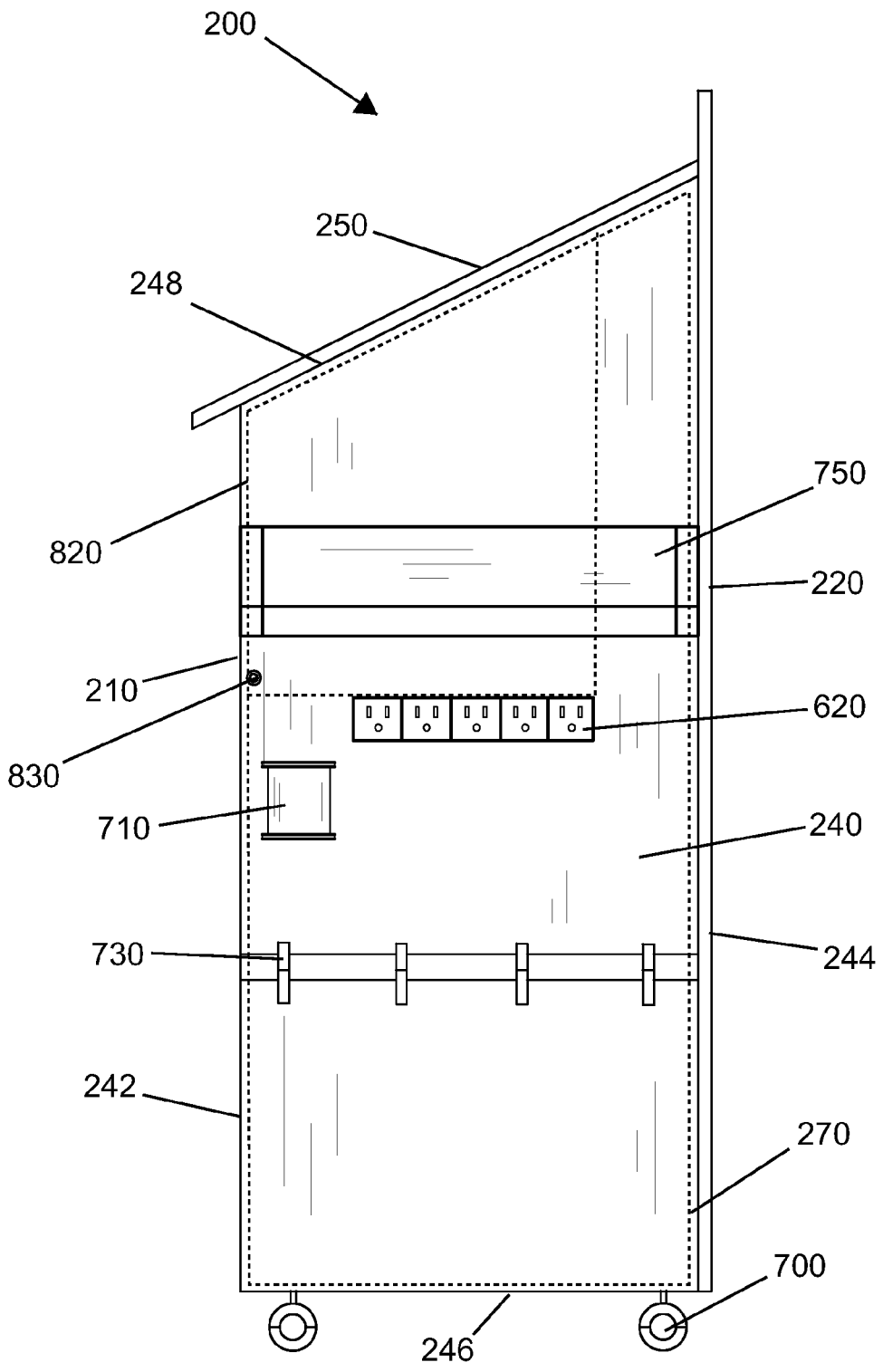
FIG. 5 is a side view of the outdoor cooking accessory cart of the present invention.
Figure 6:
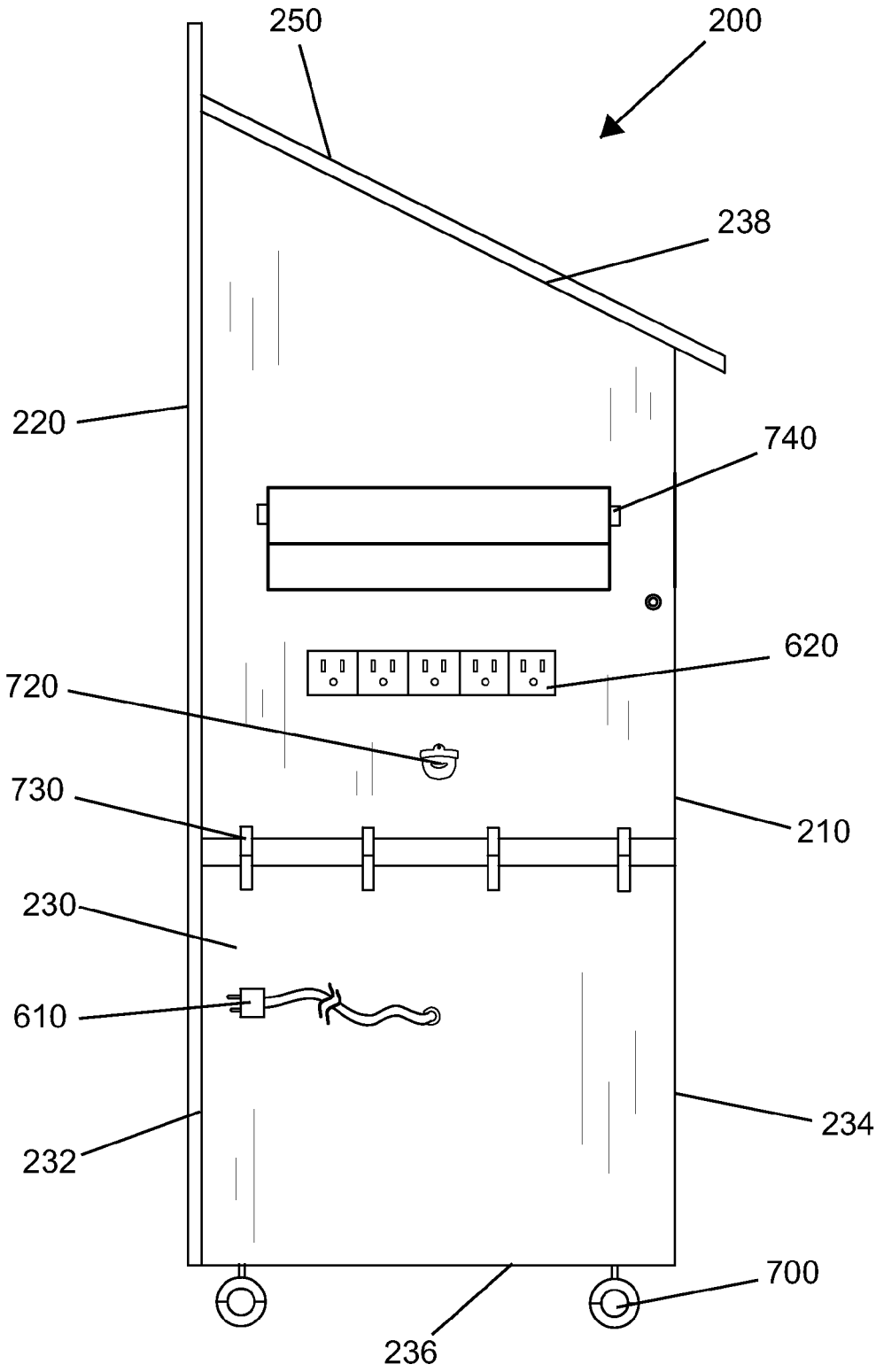
FIG. 6 is a side view of the outdoor cooking accessory cart of the present invention.
Figure 7:
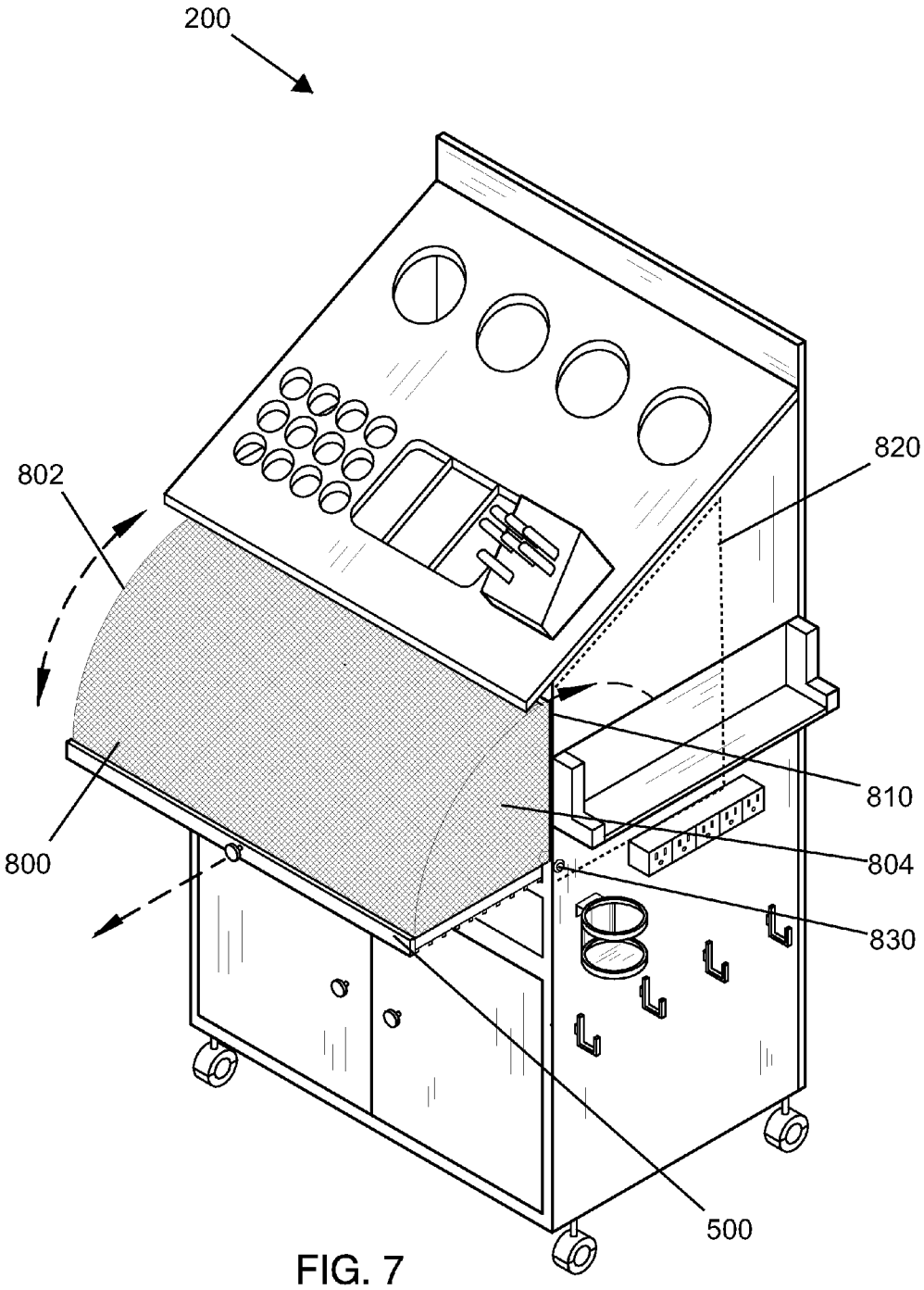
FIG. 7 is a perspective view of the outdoor cooking accessory cart of the present invention.
Figure 8:
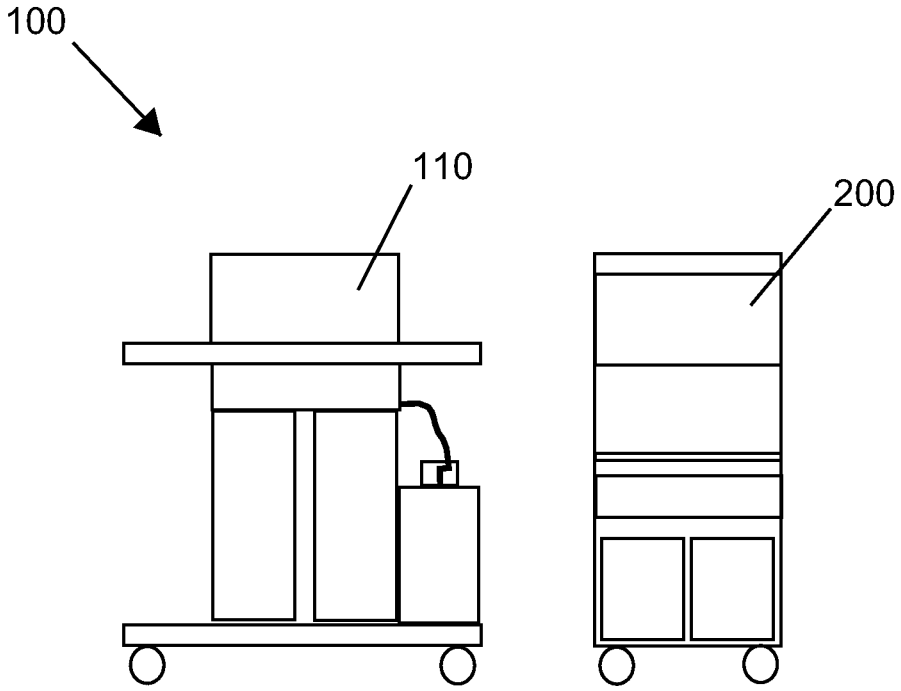
FIG. 8 is a schematic view of the present invention.
Figure 9:
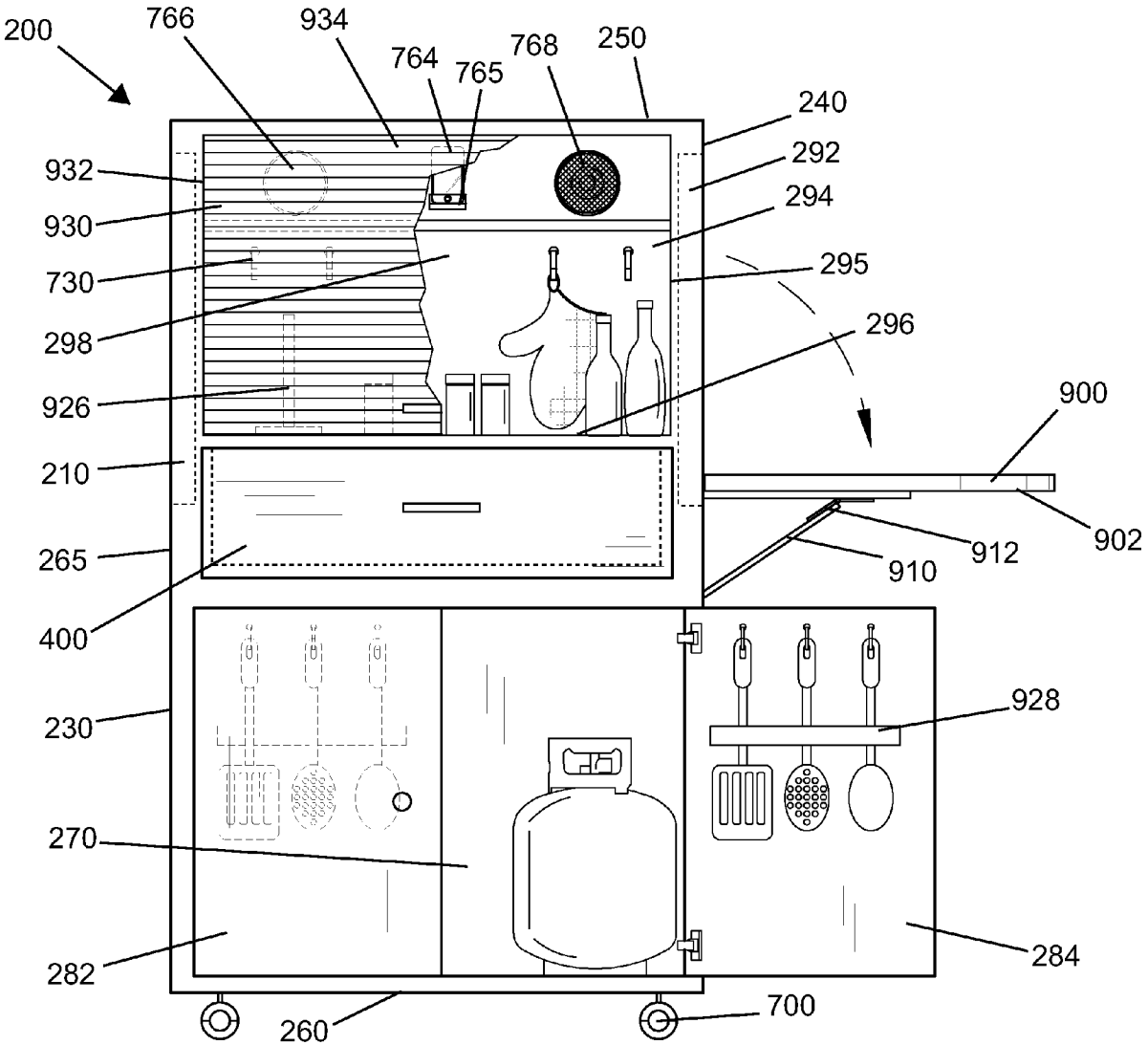
FIG. 9 is a front view of an alternate embodiment of the outdoor cooking accessory cart of the present invention.
Figure 10:
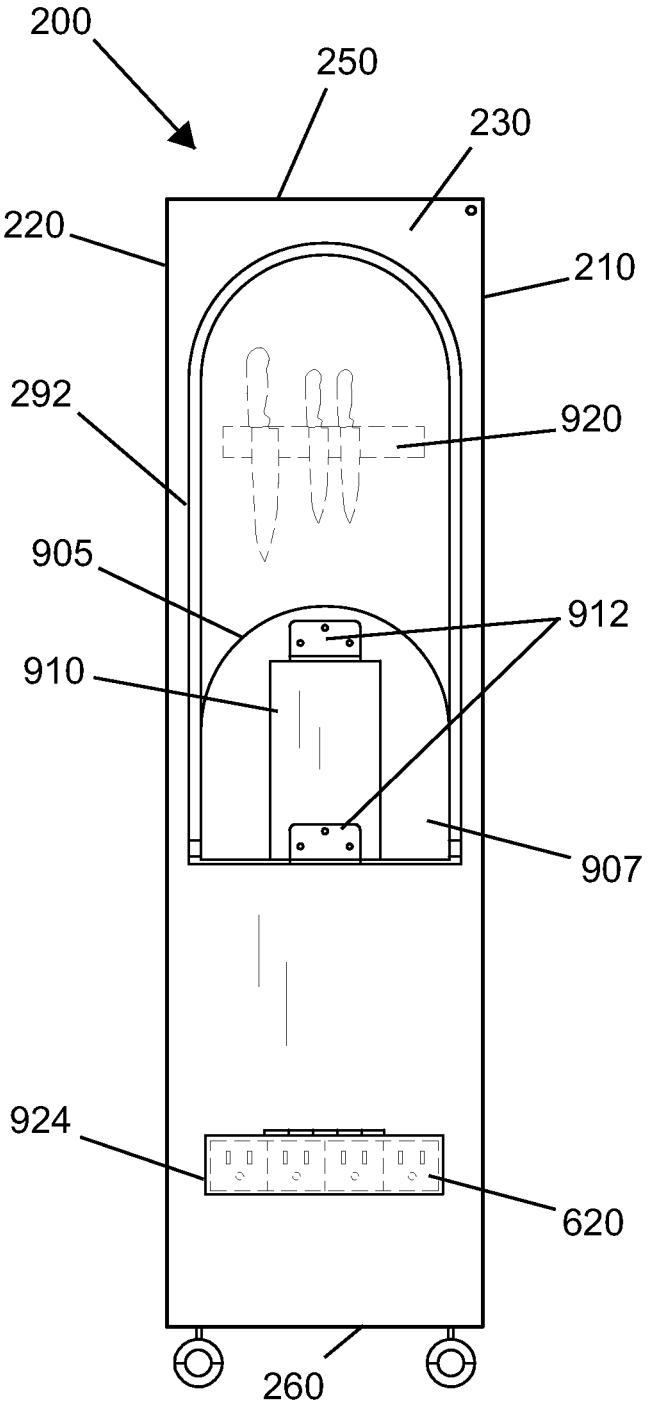
FIG. 10 is a side view of an alternate embodiment of the outdoor cooking accessory cart of the present invention.
Figure 11:
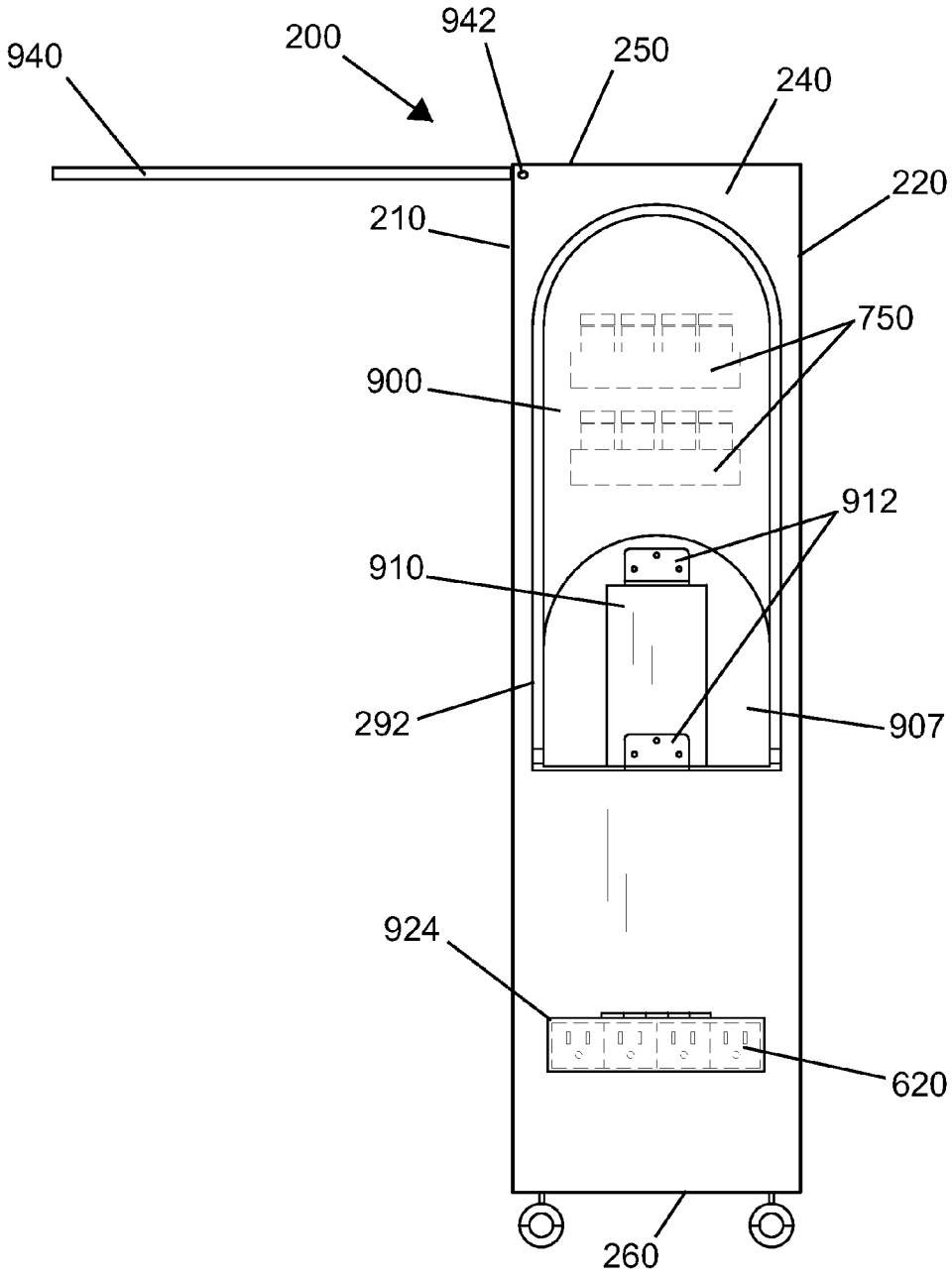
FIG. 11 is a side view of an alternate embodiment of the outdoor cooking accessory cart of the present invention.
Figure 12:
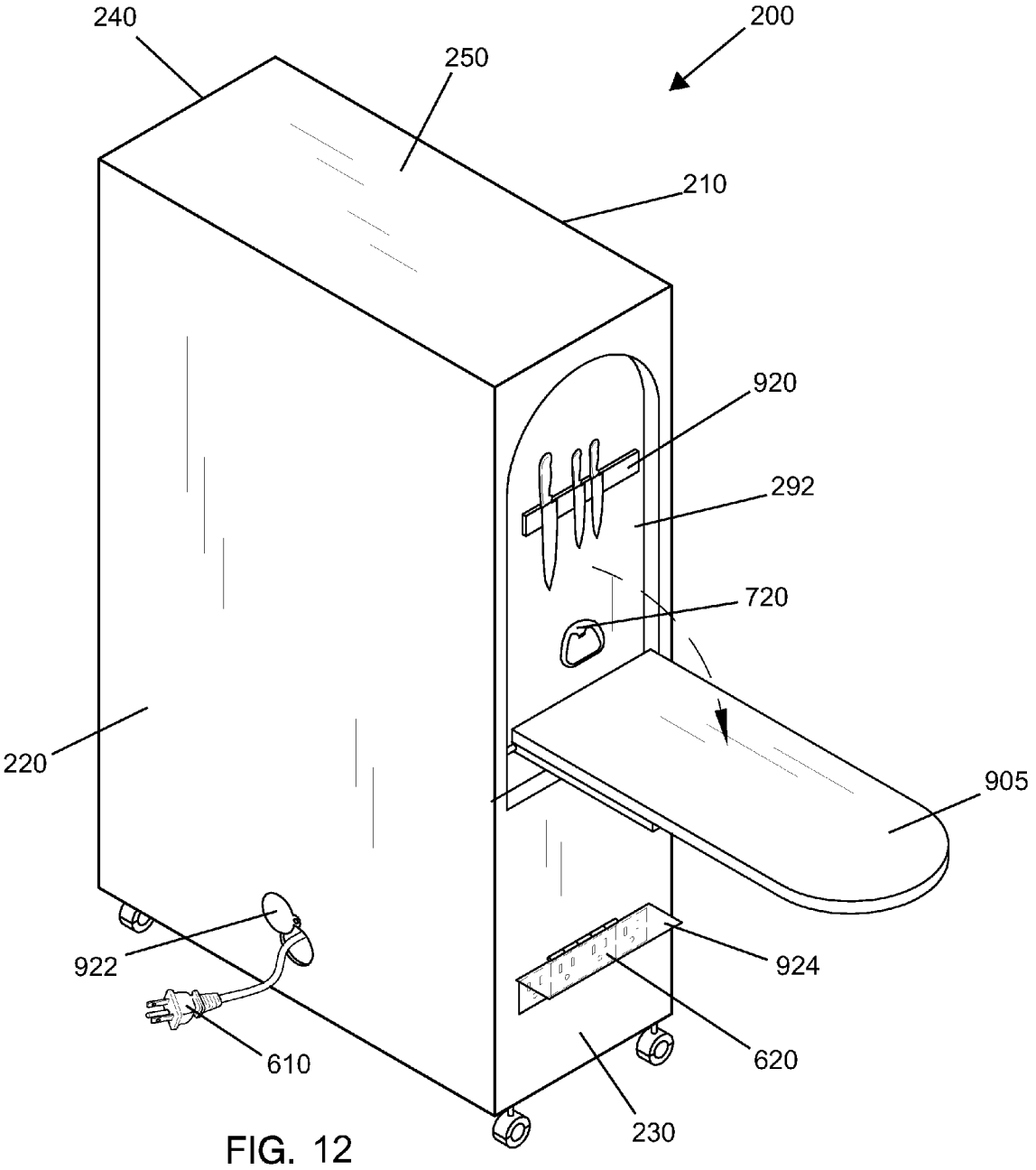
FIG. 12 is a perspective view of the cart rear surface of an alternate embodiment of the outdoor cooking accessory cart of the present invention.
Figure 13:
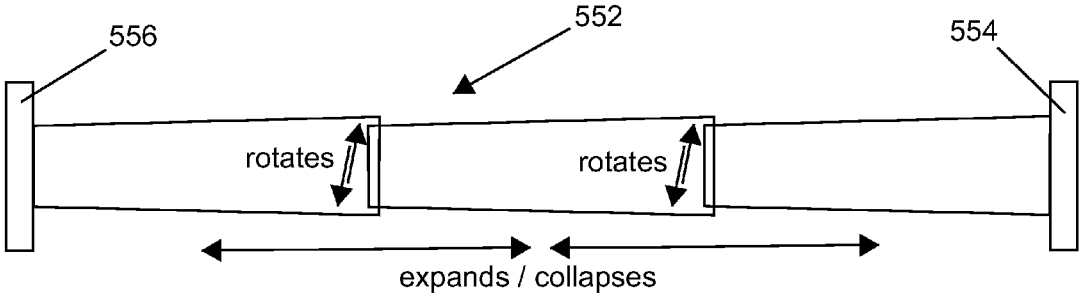
FIG. 13 is a side view of the telescopic rod of the present invention.

234 Cart first side surface second side edge
236 Cart first side surface bottom edge
238 Cart first side surface top edge
240 Cart second side surface
242 Cart second side surface first side edge
244 Cart second side surface second side edge
246 Cart second side surface bottom edge
248 Cart second side surface top edge
250 Cart top surface
252 Cart top surface front edge
253 Front lip extension
254 Cart top surface rear edge
255 Back plate
260 Cart bottom surface
265 Cart middle section
270 Cart cavity
280 Cart access aperture
282 Cart access door
284 Cart access door interior surface
290 Outdoor cooking accessory cart inside surface
292 Recessed area
294 Storage compartment
295 Storage compartment aperture
296 Storage compartment bottom surface
298 Storage compartment side surface
300 Storage bay
310 Storage bay aperture
320 Storage bay cavity
400 Drawer
410 Drawer aperture
500 Cooking shelf
502 Cooking shelf rear edge
510 Cooking shelf first surface
520 Cutting board surface
530 Cooking shelf second surface
540 Grill
550 Cylindrical channel
552 Telescopic rod
554 Telescopic rod distal end
556 Telescopic rod proximal end
560 Cooking shelf aperture
570 Plane A
572 Axis B
580 Locking mechanism
582 Pin
584 Locking aperture
586 Spring
600 Power supply
610 Connecting cord
620 Power outlet
700 Wheel
710 Cup holder
720 Bottle opener
730 Hanging hook
740 Paper towel holder
750 Shelf
760 Audio system
762 Audio system door
764 Digital music player
765 Connecting port
766 First speaker
768 Second speaker
770 Battery
780 Grill heating element
800 Insect screen
802 Insect screen first end
804 Insect screen second end
810 Insect screen aperture
820 Receiving compartment
830 Insect screen pivot member
900 Drop down table
902 Drop down table underneath surface
905 Drop down cutting board
907 Drop down cutting board underneath surface
910 Support
912 Hinge
920 Knife rack
922 Cap
924 Cover
926 Napkin holder
928 Holding strap
930 Retractable lid
932 Retractable lid aperture
934 Retractable lid segments
940 Drop down lid
942 Pivot
950 Drain hole
952 Insulation Referring now to FIG. 1-13, the present invention features an outdoor cooking organization system (100) for use when cooking. In some embodiments, the system (100) comprises an outdoor cooker (110). In some embodiments, the outdoor cooker (110) is a natural gas grill. In some embodiments, the outdoor cooker (110) is a propane grill. In some embodiments, the outdoor cooker (110) is a charcoal grill.

In some embodiments, the system (100) comprises an outdoor cooking accessory cart (200) located close or adjacent to the outdoor cooker (110) for use in conjunction with the outdoor cooker (110). In some embodiments, the outdoor cooking accessory cart (200) has a generally planar cart front surface (210), a generally planar cart rear surface (220) opposite to and parallel with the cart front surface (210), a generally planar cart first side surface (230) and a generally planar cart second side surface (240) opposite to and parallel with the cart first side surface (230).

In some embodiments, a cart front surface first side edge (212) is perpendicularly located on a cart first side surface second side edge (234). In some embodiments, a cart front surface second side edge (214) is perpendicularly located on a cart second side surface first side edge (242). In some embodiments, a cart rear surface first side edge (222) is perpendicularly located on a cart second side surface second side edge (244). In some embodiments, a cart rear surface second side edge (224) is perpendicularly located on a cart first side surface first side edge (232).

In some embodiments, the outdoor cooking accessory cart (200) further comprises a generally planar cart top surface (250) located at an angle between 90 degrees and 135 degrees with respect to the cart front surface (210). In some embodiments, the cart top surface (250) is located at an angle between 45 degrees and 90 degrees with respect to the cart rear surface (220). In some embodiments, the cart top surface (250) is located on a cart front surface top edge (218), a cart rear surface top edge (228), a cart first side surface top edge (238), and the cart second side surface top edge (248).

In some embodiments, the outdoor cooking accessory cart (200) further comprises a generally planar cart bottom surface (260). In some embodiments, the cart bottom surface (260) is perpendicularly located on a cart front surface bottom edge (216), a cart rear surface bottom edge (226), a cart first side surface bottom edge (236) and the cart second side surface bottom edge (246). In some embodiments, the cart top surface (250) does not lie in a plane parallel to a cart bottom surface (260).

In some embodiments, the outdoor cooking accessory cart (200) further comprises a cart cavity (270) located within. In some embodiments, the outdoor cooking accessory cart (200) comprises a cart access aperture (280) located on the cart front surface (210) fluidly connected to the cart cavity (270). In some embodiments, a pivotally located cart access door (282) is located on a cart front surface (210) for access to the cart cavity (270). In some embodiments, the cart cavity (270) comprises a storage rack for propane cylinders.

In some embodiments, the cart top surface (250) comprises a generally planar back plate (255) located on a cart top surface rear edge (254). In some embodiments, the back plate (255) projects out and away from the cart top surface (250). In some embodiments, the back plate (255) lies on a plane with the cart rear surface (220). In some embodiments, the back plate (255) is contiguous with the cart rear surface (220). In some embodiments, the back plate (255) is for mounting accessories, for example, clamp-on accessories. In some embodiments, the back plate (255) is for mounting accessories, for example, accessories having a base wherein the back plate (255) can be drilled and a fastener used to attach the accessories to the back plate (255).

In some embodiments, the cart top surface (250) comprises a generally planar front lip extension (253) located on a cart top surface front edge (252). In some embodiments, the front lip extension (253) projects out and away from the cart top surface (250). In some embodiments, the front lip extension (253) lies on a plane with the cart top surface (250). In some embodiments, the front lip extension (253) is contiguous with the cart top surface (250). In some embodiments, the front lip extension (253) is for mounting accessories, for example, clamp-on accessories. In some embodiments, the front lip extension (253) is for mounting accessories, for example, accessories having a base wherein the front lip extension (253) can be drilled and a fastener used to attach the accessories to the front lip extension (253). In some embodiments, the front lip extension (253) is a drip ledge providing weather and spill protection for an audio system (760), a cooking shelf aperture (560) and a drawer aperture (410).

In some embodiments, the outdoor cooking accessory cart (200) comprises a plurality of storage bays (300). In some embodiments, the storage bay (300) comprises a storage bay aperture (310) located on the cart top surface (250) fluidly connected to a storage bay cavity (320) located within the outdoor cooking accessory cart (200). In some embodiments, the storage bay (300) comprises an open front for receiving an item for storage.

In some embodiments, the outdoor cooking accessory cart (200) comprises a drawer (400). In some embodiments, the drawer (400) is inserted through a drawer aperture (410) located in the cart front surface (210). In some embodiments, the drawer (400) slides in a horizontal plane. In some embodiments, the drawer (400) comprises an open top for receiving an item for storage.

In some embodiments, the outdoor cooking accessory cart (200) comprises a generally planar retractable cooking shelf (500) having a cutting board surface (520) disposed on a cooking shelf first surface (510) and a grill (540) disposed on a cooking shelf second surface (530). In some embodiments, the cooking shelf first surface (510) is an opposing surface with respect to the cooking shelf second surface (530). In some embodiments, the cooking shelf (500) is pivotally disposed and can rotate via a telescopic rod (552). In some embodiments, the telescopic rod (552) comprises segments that spin on each other. In some embodiments, the telescopic rod (552) is expandable and collapsible. In some embodiments, a telescopic rod proximal end (556) is disposed on a cooking shelf rear edge (502). In some embodiments, a telescopic rod distal end (554) is disposed on and affixed to an outdoor cooking accessory cart inside surface (290). In some embodiments, the telescopic rod (552) is disposed in the outdoor cooking accessory cart (200) perpendicular to the cart front surface (210). In some embodiments, the cooking shelf (500) slides into and out from the outdoor cooking accessory cart (200). In some embodiments, the cooking shelf (500) is slidably guided into the outdoor cooking accessory cart (200) and planarly held into position via a generally rectangular cooking shelf aperture (560) disposed on the cart front surface (210). In some embodiments, the cooking shelf (500) is rotatable on an axis upon extension of the cooking shelf beyond the cooking shelf aperture (560). In some embodiments, the cooking shelf (500) is rotatable on an axis upon extension of the cooking shelf (500) beyond the cart front surface (210). In some embodiments, the cooking shelf (500) is rotatable on an axis, Axis B (572) upon extension of the cooking shelf beyond the cooking shelf aperture (560). In some embodiments, Axis B is perpendicular to the cart front surface (210). In some embodiments, the telescopic rod (552) lies upon Axis B (572). In some embodiments, the cooking shelf (500) is locked into a first position with the cutting board surface (520) facing upwards and parallel with the cart bottom surface (260). In some embodiments, the cooking shelf (500) is affixed into the first position by the cooking shelf aperture (560). In some embodiments, the cooking shelf (500) is locked into a second position with the grill (540) facing upwards parallel with the cart bottom surface (260). In some embodiments, the cooking shelf (500) is affixed into the first position by the cooking shelf aperture (560).

In some embodiments, the outdoor cooking accessory cart (200) comprises a generally planar retractable cooking shelf (500) having a cutting board surface (520) located on a cooking shelf first surface (510) and a grill (540) located on a cooking shelf second surface (530). In some embodiments, the cooking shelf first surface (510) is an opposing surface with respect to the cooking shelf second surface (530). In some embodiments, the cooking shelf (500) is pivots and slides on a cylindrical channel (550) located through a center cross-section of the cooking shelf (500) and a telescopic rod (552) mated with the cylindrical channel (550) located in the outdoor cooking accessory cart (200) perpendicular to the cart front surface (210). In some embodiments, the cooking shelf (500) slides into and away from the outdoor cooking accessory cart (200) via the cylindrical channel (550) and the telescopic rod (552). In some embodiments, the cooking shelf (500) is retracted into the outdoor cooking accessory cart (200) via a cooking shelf aperture (560) located on the cart front surface (210). In some embodiments, the cooking shelf (500) when extended for use rotates in a plane, Plane A (570) via the cylindrical channel (550) and the telescopic rod (552). In some embodiments, Plane A (570) is parallel to the cart front surface (210). In some embodiments, the cooking shelf (500) when extended for use rotates on an axis, Axis B (572). In some embodiments, Axis B is perpendicular to the cart front surface (210). In some embodiments, the cooking shelf (500) is locked into a first position with the cutting board surface (520) facing upwards and parallel with the cart bottom surface (260) via a spring (586) loaded locking mechanism (580). In some embodiments, the locking mechanism (580) is located on the cooking shelf (500) and interlocks the cylindrical channel (550) with the telescopic rod (552) thus affixing the cooking shelf (500) securely into a horizontally planar position. In some embodiments, the cooking shelf (500) is locked into position in a second position with the grill (540) facing upwards parallel with the cart bottom surface (260) via the locking mechanism (580). In some embodiments, the locking mechanism (580) is located on the cooking shelf (500) and interlocks the cylindrical channel (550) with the telescopic rod (552) thus affixing the cooking shelf (500) securely into a horizontally planar position.

In some embodiments, the outdoor cooking accessory cart (200) comprises a generally planar retractable cooking shelf (500) having a cutting board surface (520) located on a cooking shelf first surface (510) and a grill (540) located on a cooking shelf second surface (530). In some embodiments, the cooking shelf first surface (510) is an opposing surface with respect to the cooking shelf second surface (530). In some embodiments, the cooking shelf (500) is pivotally located via a cylindrical channel (550) located through a center cross-section of the cooking shelf (500) and a telescopic rod (552) mated with the cylindrical channel (550) located in the outdoor cooking accessory cart (200) perpendicular to the cart front surface (210). In some embodiments, a telescopic rod distal end (554) is affixed to an outdoor cooking accessory cart inside surface. In some embodiments, the cooking shelf (500) is slidable into and out from the outdoor cooking accessory cart (200). In some embodiments, the cooking shelf (500) is slidably guided into the outdoor cooking accessory cart (200) and planarly held into position via a generally rectangular cooking shelf aperture (560) located on the cart front surface (210). In some embodiments, the cooking shelf (500) is rotatable on an axis upon extension of the cooking shelf beyond the cooking shelf aperture (560). In some embodiments, the cooking shelf (500) is rotatable on an axis upon extension of the cooking shelf (500) beyond the cart front surface (210). In some embodiments, the cooking shelf (500) is rotatable on an axis, Axis B (572) upon extension of the cooking shelf beyond the cooking shelf aperture (560). In some embodiments, Axis B is perpendicular to the cart front surface (210). In some embodiments, the cooking shelf (500) is locked into a first position with the cutting board surface (520) facing upwards and parallel with the cart bottom surface (260). In some embodiments, the cooking shelf (500) is affixed into the first position by the cooking shelf aperture (560). In some embodiments, the cooking shelf (500) is locked into a second position with the grill (540) facing upwards parallel with the cart bottom surface (260). In some embodiments, the cooking shelf (500) is affixed into the first position by the cooking shelf aperture (560).

In some embodiments, the cooking shelf (500) is locked into a first position with the cutting board surface (520) facing upwards and parallel with the cart bottom surface (260) via a spring (586) loaded locking mechanism (580). In some embodiments, the spring (586) loaded locking mechanism (580) comprises a pin (582) biased into a projected position by a spring (586). In some embodiments, the pin (582) is disposed perpendicularly on a first end of the telescopic rod (552) projecting outward. In some embodiments, the pin (582) is received by an locking aperture (584) disposed in a side wall of the cylindrical channel (550) for affixing the cooking shelf (500) securely into position. In some embodiments, the locking mechanism (580) interlocks the cylindrical channel (550) with the telescopic rod (552) thus affixing the cooking shelf (500) securely into position. In some embodiments, the cooking shelf (500) is locked into position in a second position with the grill (540) facing upwards parallel with the cart bottom surface (260) via the locking mechanism (580).

In some embodiments, the outdoor cooking accessory cart (200) comprises a power supply (600) having a connecting cord (610) for connecting to an alternating current power source. In some embodiments, a power outlet (620) is located on the outdoor cooking accessory cart (200) and operatively connected to the power supply (600).

In some embodiments, the cart bottom surface (260) comprises a plurality of wheels (700) located thereon for interfacing with a ground surface.

In some embodiments, the outdoor cooking accessory cart (200) comprises one or more items located thereon selected from a group consisting of the following: cup holder (710), bottle opener (720), hanging hook (730), or paper towel holder (740).

In some embodiments, the outdoor cooking accessory cart (200) comprises a shelf (750) located on the cart first side surface (230) or the cart second side surface (240).

In some embodiments, the outdoor cooking accessory cart (200) comprises an audio system (760) located therein. In some embodiments, the audio system (760) is operatively connected to the power supply (600). In some embodiments, the audio system (760) comprises a audio system door (762) for concealing an operating interface of the audio system (760).

In some embodiments, the power supply (600) comprises a battery (770). In some embodiments, the power supply (600) comprises a voltage conversion device to convert alternating current power to direct current power. In some embodiments, the power supply (600) comprises a battery charger.

In some embodiments, the grill (540) located on the cooking shelf second surface (530) further comprises a grill heating element (780) located between the cooking shelf second surface (530) and the grill (540). In some embodiments, the grill heating element (780) is operatively connected to the power supply (600). In some embodiments, the grill heating element (780) is operatively connected to the power supply (600) via contacts located on the cylindrical channel (550) and the telescopic rod (552). In some embodiments, the grill heating element (780) is operatively connected to the power supply (600) via contacts located on the cooking shelf rear edge (502) and the telescopic rod (552).

In some embodiments, the storage bays (300) are adapted to receive one or more items selected from a group consisting of the following: a spice container, a condiment container, a knife block, a knife, or a grilling utensil (tongs, fork, spatula, etc.).

In some embodiments, the system (100) comprises an insect screen (800) pivotally located on the cart front surface (210). In some embodiments, the system (100) comprises an insect screen aperture (810) located on the cart front surface (210) for receiving the insect screen (800) for storage. In some embodiments, the insect screen (800) tilts into a receiving compartment (820) located inside the outdoor cooking accessory cart (200) for storage. In some embodiments, the receiving compartment (820) is fluidly connected to the insect screen aperture (810). In some embodiments, the insect screen (800) is for covering the cooking shelf (500).

In some embodiments, the system (100) comprises an insect screen (800) pivotally located on the cart front surface (210) via an insect screen pivot member (830). In some embodiments, the system (100) further comprises an insect screen aperture (810) located on the cart front surface (210) for receiving the insect screen (800) for storage. In some embodiments, the insect screen aperture (810) comprises a general "U" shaped slot. In some embodiments, the insect screen aperture (810) is fluidly connected to a receiving compartment (820). In some embodiments, the receiving compartment (820) is disposed in the outdoor cooking accessory cart (200). In some embodiments, the receiving compartment (820) is disposed in the cart cavity (270). In some embodiments, the receiving compartment (820) comprises a general shape of a rectangular prism. In some embodiments, the insect screen (800) is for covering the cooking shelf (500). In some embodiments, the insect screen (800) comprises a general shape of a quadrant of a cylinder intersected by a sagittal plane and a coronal plane. In some embodiments, the insect screen (800) comprises an insect screen first end (802) having a general shape of a quadrant of a circle. In some embodiments, the insect screen (800) comprises an insect screen second end (804) having a general shape of a quadrant of a circle. In some embodiments, the insect screen (800) comprises a generally arc-shaped central cover disposed between the insect screen first end (802) and the insect screen second end (804).

In some embodiments the audio system (760) is located on the cart front surface (210) close to the cart top surface (250). In some embodiments, the audio system (760) comprises a digital music player (764). In some embodiments, the audio system (760) is operatively attached to the power supply (600). In some embodiments the audio system (760) comprises a first speaker (766) and a second speaker (768) operatively connected thereto. In some embodiments, the audio system (760) comprises a connecting port (765) for attaching a separate digital music player (764). In some embodiments, the digital music player (764) is an IPod®. In some embodiments, the outdoor cooking accessory cart (200) comprises a retractable lid (930) for covering the audio system (760). In some embodiments, the retractable lid (930) is stored in the cart cavity (270) upon retraction. In some embodiments, the retractable lid (930) slides from a retractable lid aperture (932) located in the cart front surface (210).

In some embodiments, a storage compartment (294) is located close to a middle section (265) of the outdoor cooking accessory cart (200). In some embodiments, a storage compartment aperture (295) is located in the cart front surface (210) and is fluidly connected to the storage compartment (294). In some embodiments, the storage compartment (294) comprises a storage bay (300) located on a storage compartment bottom surface (296) therein wherein the storage compartment bottom surface (296) is parallel to the cart bottom surface (260). In some embodiments, the storage compartment (294) comprises a hanging hook (730) located on a storage compartment side surface (298) therein, wherein the storage compartment side surface (298) is vertical. In some embodiments, the storage compartment (294) comprises a napkin holder (926) located therein. In some embodiments, the storage compartment (294) comprises a retractable lid (930). In some embodiments, the retractable lid (930) covers the storage compartment (294). In some embodiments, the retractable lid (930) is stored in the cart cavity (270) upon retraction. In some embodiments, the retractable lid (930) slides from a retractable lid aperture (932) located in the cart front surface (210).

In some embodiments, the outdoor cooking accessory cart (200) comprises a retractable lid (930). In some embodiments, the retractable lid (930) covers the audio system (760) and the storage compartment (294). In some embodiments, the retractable lid (930) is stored in the cart cavity (270) upon retraction. In some embodiments, the retractable lid (930) slides from a retractable lid aperture (295) located in the cart front surface (210). In some embodiments, the retractable lid (930) comprises pivotally attached retractable lid segments (934). In some embodiments, the retractable lid (930) slides out from the outdoor cooking accessory cart (200).

In some embodiments, the outdoor cooking accessory cart (200) comprises a pivotally mounted drop down lid (940). In some embodiments the drop down lid (940) covers the audio system (760). In some embodiments, the drop down lid (940) covers the storage compartment (294). In some embodiments, the drop down lid (940) covers the audio system (760) and the storage compartment (294). In some embodiments the drop down lid (940) comprises a pivot (942) located on each side of the drop down lid (940) for attaching to the cart front surface (210) close to the cart top surface (250). In some embodiments, the drop down lid (940), when raised, is stored in the cart cavity (270). In some embodiments, the drop down lid (940), when raised, is stored above the cart top surface (250).

In some embodiments, the cart access door (282) comprises a hanging hook (730) located on a cart access door interior surface (284) for hanging a utensil. In some embodiments, the cart access door (282) comprises a holding strap (928) for securing a utensil when located on the hanging hook (730).

In some embodiments, the cart top surface (250) is planar and parallel with the cart bottom surface (260). In some embodiments, the cart top surface (250) is continuous with no apertures located within.

In some embodiments, the cart first side surface (230) or second side surface (240) comprises a drop down table (900). In some embodiments, the drop down table (900) is pivotally attached to the cart first side surface (230) or second side surface (240). In some embodiments, the drop down table (900) is affixed into place via a pivotally attached support (910) located on a drop down table underneath surface (902). In some embodiments, the support (910) pivotally collapses via a hinge (912). In some embodiments, the drop down table (900) is located on a horizontal plane for use. In some embodiments, the drop down table (900) is pivoted upwardly and located on a vertical plane for storage.

In some embodiments, the cart first side surface (230) or second side surface (240) comprises a drop down cutting board (905). In some embodiments, the cutting board (905) is pivotally attached to the cart first side surface (230) or second side surface (240). In some embodiments, the cutting board (905) is affixed into place via a pivotally attached support (910) located on a cutting board underneath surface (907). In some embodiments, the support (910) pivotally collapses via a hinge (912). In some embodiments, the drop down cutting board (905) is located on a horizontal plane for use. In some embodiments, the drop down cutting board (905) is pivoted upwardly and located on a vertical plane for storage.

In some embodiments, the cart first side surface (230) and the cart second side surface (240) comprise a recessed area (292) for receiving a drop down table (900) or a drop down cutting board (905). In some embodiments, the drop down table (900) or the drop down cutting board (905) folds up and into the recessed area (292) for storage. In some embodiments, the drop down table (900) or the drop down cutting board (905) do not project out from the cart first side surface (230) or cart second side surface (240) when folded away for storage into the recessed area (292). In some embodiments the recessed area (292) comprises a knife rack (920) located therein. In some embodiments, the recessed area (292) comprises shelves (750) for spices located therein. In some embodiments, the recessed area (292) comprises a bottle opener (720) located therein.

In some embodiments, the connecting cord (610) is located on and extends from the cart rear surface (220) close to the cart bottom surface (260). In some embodiments, when not in use, the connecting cord (610) is located inside the cart cavity (270). In some embodiments, when not in use the aperture through which the connecting cord (610) exits the outdoor cooking accessory cart (200) is covered by a cap (922). In some embodiments, the power outlet (620) comprises a cover (924) located thereon.

In some embodiments, the drawer (400) comprises a drain hole (950) located in a bottom thereof for drainage of condensation or other contents. In some embodiments, the drawer (400) comprises insulation (952) located on a drawer side for insulating the drawer (400) to be used for maintaining a temperature of the contents thereof. In some embodiments, the drawer (400) comprises insulation (952) located on a drawer bottom for insulating the drawer (400) to be used for maintaining a temperature of the contents thereof. In some embodiments, the drawer (400) comprises an insulated top cover to cover the drawer contents for insulating the drawer (400) to be used for maintaining a temperature of the contents thereof.

As used herein, the term "about" refers to plus or minus 10% of the referenced number. For example, an embodiment wherein the drawer is about 10 inches in length includes a drawer that is between 9 and 11 inches in length.

The disclosures of the following U.S. Patents are incorporated in their entirety by reference herein: U.S. Pat. Pub. No. 2002/0130598; U.S. Pat. Pub. No. 2006/0062415; U.S. Pat. No. 1,985,412; U.S. Pat. No. 3,082,050; U.S. Pat. No. 3,915,529; U.S. Pat. No. 5,269,599; U.S. Pat. No. 6,554,853; U.S. Pat. No. 5,806,944.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An outdoor cooking organization system (100) for use when cooking, wherein said system (100) comprises:

(a) an outdoor cooker (110); and (b) an outdoor cooking accessory cart (200) disposed proximal to or adjacent to the outdoor cooker for use in conjunction with the outdoor cooker, wherein the outdoor cooking accessory cart (200) comprises a generally planar cart front surface (210), a generally planar cart rear surface (220) opposite to and parallel with the cart front surface (210), a generally planar cart first side surface (230) and a generally planar cart second side surface (240) opposite to and parallel with the cart first side surface (230), wherein a cart front surface first side edge (212) is perpendicularly disposed on a cart first side surface second side edge (234), wherein a cart front surface second side edge (214) is perpendicularly disposed on a cart second side surface first side edge (242), wherein a cart rear surface first side edge (222) is perpendicularly disposed on a cart second side surface second side edge (244), wherein a cart rear surface second side edge (224) is perpendicularly disposed on a cart first side surface first side edge (232), wherein the outdoor cooking accessory cart (200) further comprises a generally planar cart top surface (250) disposed at an angle between 90 degrees and 135 degrees with respect to the cart front surface (210), wherein the cart top surface (250) is disposed at an angle between 45 degrees and 90 degrees with respect to the cart rear surface (220), wherein the cart top surface (250) is disposed on a cart front surface top edge (218), a cart rear surface top edge (228), a cart first side surface top edge (238) and the cart second side surface top edge (248), wherein the outdoor cooking accessory cart (200) further comprises a generally planar cart bottom surface (260), wherein the cart bottom surface (260) is perpendicularly disposed on a cart front surface bottom edge (216), a cart rear surface bottom edge (226), a cart first side surface bottom edge (236) and the cart second side surface bottom edge (246), wherein the outdoor cooking accessory cart (200) further comprises a cart cavity (270) disposed within, wherein the outdoor cooking accessory cart (200) comprises an cart access aperture (280) disposed on the cart front surface (210) fluidly connected to the cart cavity (270), wherein a pivotally disposed cart access door (282) is disposed on the cart front surface (210) for access to the cart cavity (270), wherein the cart top surface (250) comprises a generally planar back plate (255) disposed on a cart top surface rear edge (254), wherein the back plate (255) projects out and away from the cart top surface (250), wherein the back plane lies on a plane with the cart rear surface (220), wherein the cart top surface (250) comprises a generally planar front lip extension (253) disposed on a cart top surface front edge (252), wherein the front lip extension (253) projects out and away from the cart top surface (250), wherein the front lip extension (253) lies on a plane with the cart top surface (250), (i) a plurality of storage bays (300), wherein the storage bay (300) comprises an storage bay aperture (310) disposed on the cart top surface (250) fluidly connected to a storage bay cavity (320) disposed within the outdoor cooking accessory cart (200), wherein the storage bay (300) comprises an open front for receiving an item for storage, (ii) a drawer (400), wherein the drawer (400) is inserted through an drawer aperture (410) disposed in the cart front surface (210), wherein the drawer (400) is slidable in a horizontal plane, wherein the drawer (400) comprises an open top for receiving an item for storage, (iii) a generally planar retractable cooking shelf (500) having a cutting board surface (520) disposed on a cooking shelf first surface (510) and a grill (540) disposed on a cooking shelf second surface (530), wherein the cooking shelf first surface (510) is an opposing surface with respect to the cooking shelf second surface (530), wherein the cooking shelf (500) is pivotally disposed via a telescopic rod (552), wherein the telescopic rod (552) comprises segments that spin on each other, wherein the telescopic rod (552) is expandable and collapsible, wherein a telescopic rod proximal end (556) is disposed on a cooking shelf rear edge (502), wherein a telescopic rod distal end (554) is disposed on and affixed to an outdoor cooking accessory cart inside surface (290), wherein the telescopic rod (552) is disposed in the outdoor cooking accessory cart (200) perpendicular to the cart front surface (210), wherein the cooking shelf (500) is slidable into and out from the outdoor cooking accessory cart (200), wherein the cooking shelf (500) is slidably guided into the outdoor cooking accessory cart (200) and planarly held into position via a generally rectangular cooking shelf aperture (560) disposed on the cart front surface (210), wherein the cooking shelf (500) is rotatable on an axis upon extension of the cooking shelf beyond the cooking shelf aperture (560), wherein the cooking shelf (500) is rotatable on an axis upon extension of the cooking shelf (500) beyond the cart front surface (210), wherein the cooking shelf (500) is rotatable on an axis, Axis B (572) upon extension of the cooking shelf beyond the cooking shelf aperture (560), wherein Axis B is perpendicular to the cart front surface (210), wherein the telescopic rod (552) lies upon Axis B (572), wherein the cooking shelf (500) is locked into a first position with the cutting board surface (520) facing upwards and parallel with the cart bottom surface (260), wherein the cooking shelf (500) is affixed into the first position by the cooking shelf aperture (560), wherein the cooking shelf (500) is locked into a second position with the grill (540) facing upwards parallel with the cart bottom surface (260), wherein the cooking shelf (500) is affixed into the first position by the cooking shelf aperture (560), and (iv) a power supply (600) having a connecting cord (610) for connecting to an alternating current power source, wherein a power outlet (620) is disposed on the outdoor cooking accessory cart (200) and operatively connected to the power supply (600).

2. The system (100) of claim 1, wherein the cart bottom surface (260) comprises a plurality of wheels (700) disposed thereon for interfacing with a ground surface.

3. The system (100) of claim 1, wherein the outdoor cooking accessory cart (200) comprises one or more items disposed thereon selected from a group consisting of the following: cup holder (710), bottle opener (720), hanging hook (730), or paper towel holder (740).

4. The system (100) of claim 1, wherein the outdoor cooking accessory cart (200) comprises a shelf (750) disposed on the cart first side surface (230) or the cart second side surface (240).

5. The system (100) of claim 1, wherein the outdoor cooking accessory cart (200) comprises an audio system (760) disposed therein, wherein the audio system (760) is operatively connected to the power supply (600).

6. The system (100) of claim 5, wherein the audio system (760) comprises a audio system door (762) for concealing an operating interface of the audio system (760).

7. The system (100) of claim 1, wherein the power supply (600) comprises a battery (770).

8. The system (100) of claim 1 wherein the grill (540) disposed on the cooking shelf second surface (530) further comprises a grill heating element (780) disposed between the cooking shelf second surface (530) and the grill (540), wherein the grill heating element (780) is operatively connected to the power supply (600).

9. The system (100) of claim 1, wherein the storage bays (300) are adapted to receive one or more items selected from a group consisting of the following: a spice container, a condiment container, a knife block, a knife, a grilling utensil (tongs, fork, spatula, etc.).

10. The system (100) of claim 1, wherein the system (100) comprises an insect screen (800) pivotally disposed on the cart front surface (210) via an insect screen pivot member (830), wherein the system (100) further comprises an insect screen aperture (810) disposed on the cart front surface (210) for receiving the insect screen (800) for storage, wherein the insect screen aperture (810) comprises a general "U" shaped slot, wherein the insect screen aperture (810) is fluidly connected to a receiving compartment (820), wherein the receiving compartment (820) is disposed in the outdoor cooking accessory cart (200), wherein the receiving compartment (820) is disposed in the cart cavity (270), wherein the receiving compartment (820) comprises a general shape of a rectangular prism, wherein the insect screen (800) is for covering the cooking shelf (500), wherein the insect screen (800) comprises a general shape of a quadrant of a cylinder intersected by a sagittal plane and a coronal plane, wherein the insect screen (800) comprises an insect screen first end (802) having a general shape of a quadrant of a circle, wherein the insect screen (800) comprises an insect screen second end (804) having a general shape of a quadrant of a circle, wherein the insect screen (800) comprises a generally arc-shaped central cover disposed between the insect screen first end (802) and the insect screen second end (804).

11. The system (100) of claim 1, wherein the cooking shelf (500) is locked into a first position with the cutting board surface (520) facing upwards and parallel with the cart bottom surface (260) via a spring (586) loaded locking mechanism (580), wherein the spring (586) loaded locking mechanism (580) comprises a pin (582) biased into a projected position by a spring (586), wherein the pin (582) is disposed perpendicularly on a first end of the telescopic rod (552) projecting outward, wherein the pin (582) is received by a locking aperture (584) disposed in a side wall of the cylindrical channel (550) for affixing the cooking shelf (500) securely into position, wherein the locking mechanism (580) interlocks the cylindrical channel (550) with the telescopic rod (552) thus affixing the cooking shelf (500) securely into position, wherein the cooking shelf (500) is locked into position in a second position with the grill (540) facing upwards parallel with the cart bottom surface (260) via the locking mechanism (580).

* * * * *